US007630660B2

(12) United States Patent
Kolb

(10) Patent No.: US 7,630,660 B2
(45) Date of Patent: Dec. 8, 2009

(54) INTELLIGENT TONER CHARGING SYSTEM AND METHOD

(75) Inventor: Kurt Robert Thor Kolb, Hillingdon (GB)

(73) Assignee: Xerox Corporation, Norwalk, CT (US)

( * ) Notice: Subject to any disclaimer, the term of this patent is extended or adjusted under 35 U.S.C. 154(b) by 144 days.

(21) Appl. No.: 11/776,740

(22) Filed: Jul. 12, 2007

(65) Prior Publication Data

US 2009/0016754 A1 Jan. 15, 2009

(51) Int. Cl.
*G03G 15/08* (2006.01)

(52) U.S. Cl. ..... 399/53; 399/29; 399/254

(58) Field of Classification Search ..... 399/29, 399/53, 254
See application file for complete search history.

(56) References Cited

U.S. PATENT DOCUMENTS 5,194,895 A * 3/1993 Bares ..... 399/82
6,463,224 B1 * 10/2002 Phillips ..... 399/27
7,149,437 B2 * 12/2006 Okubo ..... 399/27
2003/0118377 A1 * 6/2003 Hirano ..... 399/284

* cited by examiner

*Primary Examiner*—David M Gray
*Assistant Examiner*—Barnabas T Fekete
(74) *Attorney, Agent, or Firm*—Oliff & Berridge, PLC

(57) ABSTRACT

A method and apparatus for charging toner for an imaging device includes an inactivity determining section that determines one or more periods of inactivity of the printing machine, a measuring section that measures a charge of the toner, and a charging section that charges the toner to a predetermined level based on at least one of the determined one or more periods of inactivity and the measured charge of the toner. The toner is charged to a predetermined level after recovery from the inactivity period so that the tribo-electric charge of the toner is enhanced for normal printing without causing unwanted effects when the imagining device recovers from inactivity.

14 Claims, 5 Drawing Sheets

INTELLIGENT TONER CHARGING SYSTEM AND METHOD

BACKGROUND

An imaging device, such as a xerographic machine, becomes inactive when not in use. When the imaging device becomes inactive for a long period of time, the device is often put into a "sleep mode" in which most of the electric power is cut off to save energy. When the imaging device "wakes up" from the sleep mode, the device starts warming up and performs imaging operations with toner.

SUMMARY

The toner used in such an imaging device is charged with a tribo-electro-static charge (also known as tribo). A toner concentration (TC) sensor measures the concentration of the toner in the developer by detecting the tribo charge of the toner, and based on the output of the TC sensor, a toner dispenser may adjust the supply of toner to increase the concentration of the toner when the concentration of toner is low.

If the imaging device is inactive for a long period of time, such as from the end of a business day to the next morning, the tribo charge of the toner may decrease. The tribo charge greatly affects the image quality in an imaging operation. Therefore, the image quality in an imaging operation after a delayed period may become inconsistent and darker than the image quality during normal or continual use.

The exemplary embodiments address these and other issues. For example, in various exemplary embodiments, a method for charging a toner used in an imaging device may include determining one or more periods of inactivity of the imaging device, and charging the toner to a predetermined level based on the determined period of inactivity.

In various exemplary embodiments, a method for charging toner used in an imaging device may include determining one or more periods of inactivity of the imaging device, measuring a toner charge level when the printing machine is recovered from the inactivity, and charging the toner to a predetermined level based on a difference between the measured charge of toner and a predetermined level.

In various exemplary embodiments, an apparatus for charging a developer in an imaging device may include an inactivity determining section that determines one or more periods of inactivity of the imaging device, and a charging section that charges the toner to a predetermined level.

In various exemplary embodiments, the above-described method and/or apparatus may be included in a xerographic machine.

These and other features and advantages of the disclosed embodiments are described in, or are apparent from, the following detailed description of various exemplary embodiments.

BRIEF DESCRIPTION OF THE DRAWINGS

Various exemplary embodiments of disclosed systems and methods will be described, in detail, with reference to the following figures, wherein.

DETAILED DESCRIPTION OF EMBODIMENTS

In various exemplary embodiments, the tribo charge of toner is returned to the level of normal operation after recovering from the inactivity. Using an intelligent method for controlling the tribo charge of toner, problems in the related art developer encounters are overcome or reduced. In various exemplary embodiments, the imaging device discussed herein includes, but is not limited to, a printer, copier, fax machine and any other printing device that may be suitable according to the exemplary embodiments.

While the present disclosure will be described in connection with exemplary embodiments thereof, it will be understood that it is not intended to limit the disclosure to any one embodiment. On the contrary, it is intended to cover all alternatives, modifications, and equivalents as may be included within the spirit and scope of the disclosure as defined by the claims.

A structure of an exemplary printing device is described. Here, a black and white printing machine is described as an example. However, as described later, it is appreciated that a universal developer may be used in a multicolor printing machine as well.

Figure 1:
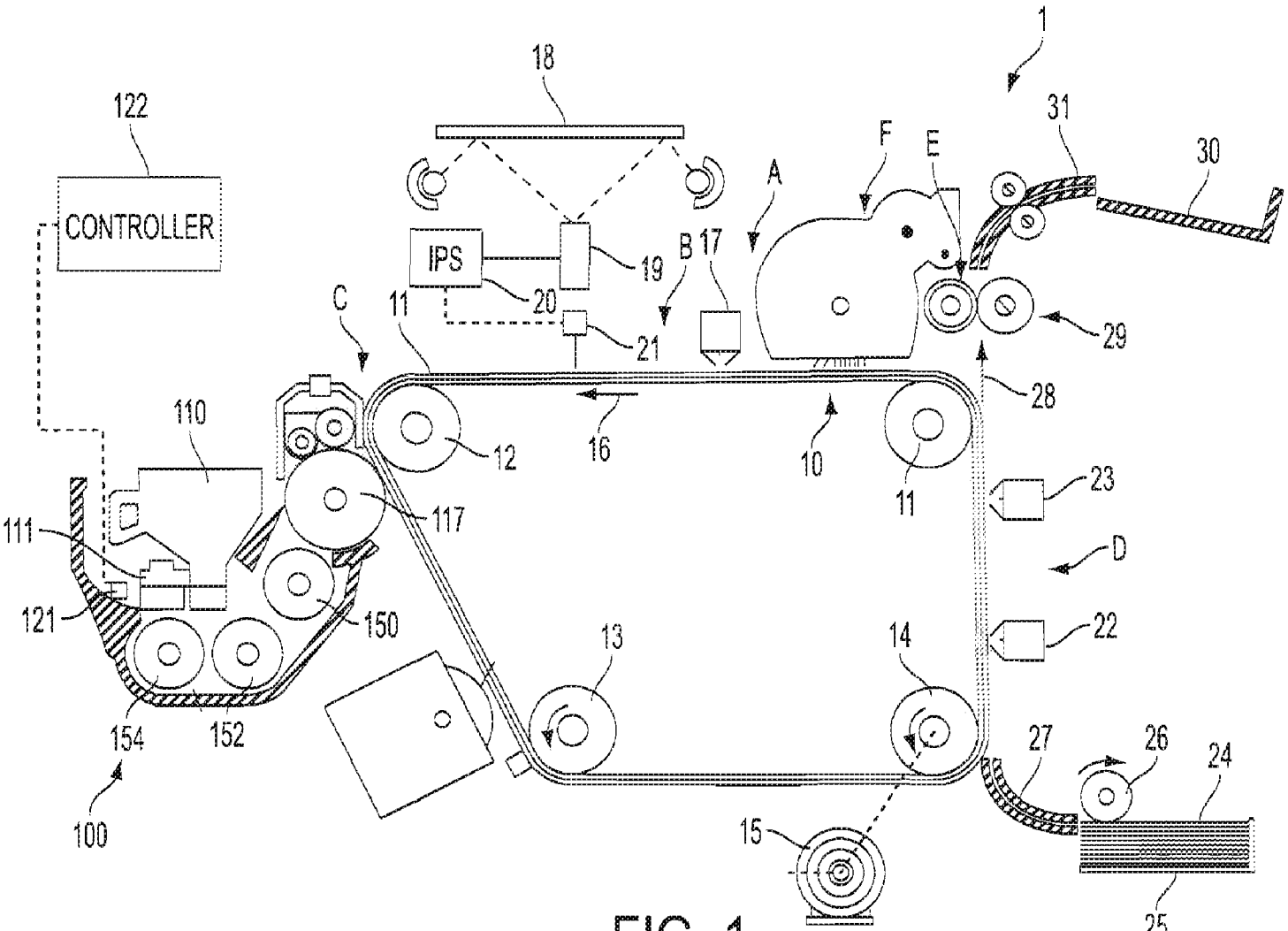
FIG. 1 is a diagram showing an imaging device according to an exemplary embodiment.

As shown in FIG. 1, an exemplary printing machine 1 may include a photoreceptor belt 10. The photoreceptor belt 10 may be supported by rollers 11, 12, 13, and 14. A motor 15 may operate the movement of the roller 14, which in turn causes movement of the photoreceptor belt 10 in a direction, for example, indicated by an arrow 16, for advancing the photoreceptor sequentially through the various xerographic stations.

A portion of the photoreceptor belt 10 passes through a charging station A where a corona generating device 17 charges the photoconductive surface of the belt 10 to a relatively high, substantially uniform potential. The charged portion of the photoconductive surface is advanced through an imaging and an exposure station B. A document 18 may be positioned on a raster input scanner (RIS) 19. One common type of RMS contains document illumination lamps, optics, a mechanical scanning drive, and a charged coupled device. The MIS captures the entire image from original document 18 and converts it to a series of raster scan lines. Alternatively, image signals may be supplied by an undepicted computer network. This information is transmitted as electrical signals to an image processing system (IPS) 20. The IPS 20 converts image information into signals.

The IPS 20 contains control electronics which prepare and manage the image data flow to a raster output scanning device (ROS) 21, which creates the output copy image. When exposed at the exposure station B, the image areas are discharged to create an electrostatic latent image of the document.

An exemplary developer station C, indicated generally by the reference numeral 100 (hereinafter referred to as a developer 100), advances development material into contact with the electrostatic latent image. The developer 100 may include a developer housing holding toner and a developer, i.e., carrier. The toner may be provided in a toner container 110, and the developer may be provided in a developer container 111. The toner container 110 and the developer container 111 may be installed on the developer station 100.

The complete developer in the developer container 111 may be added to the developer housing 100 prior to installing the toner container 110. Once the developer has been added to the housing 100, the empty developer container 110 may be removed. The toner container 110 may then be installed in the housing 100. The toner dispensed from the toner container 110 and the developer dispensed from the developer container 111 are mixed in the developer housing 100.

Figure 2:
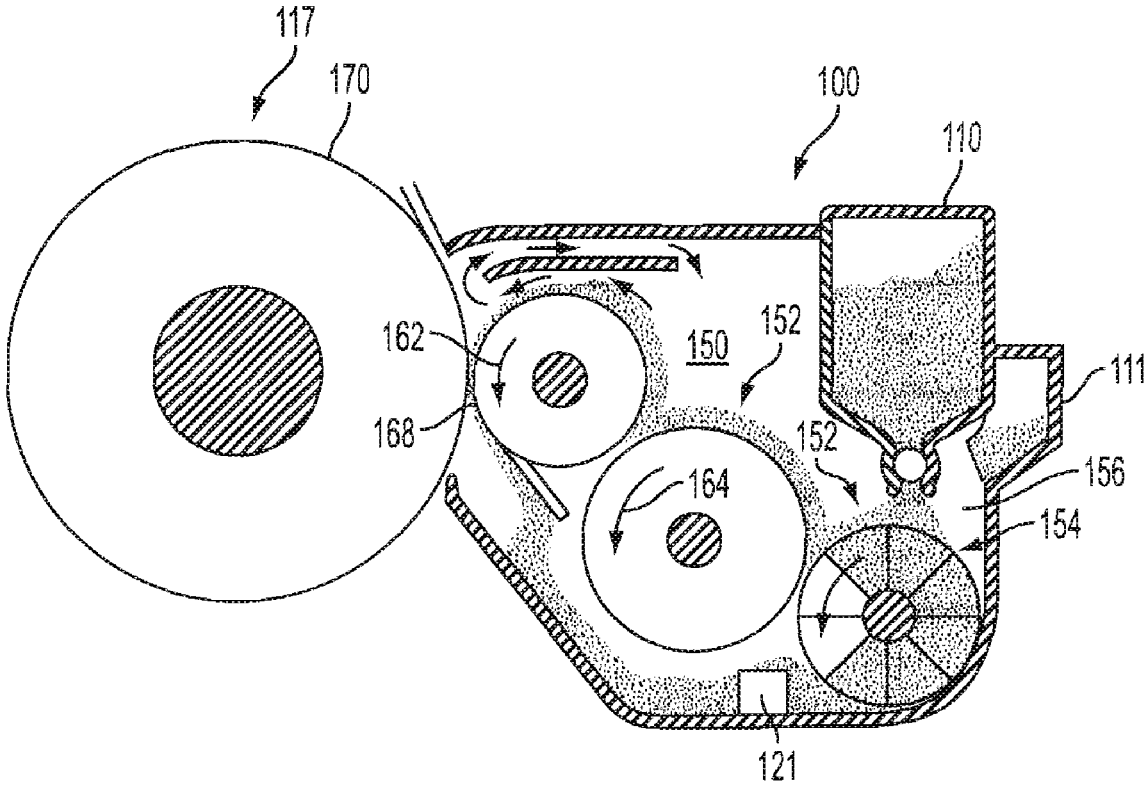
FIG. 2 illustrates a toner and developer supply system according to an exemplary embodiment.

FIG. 2 illustrates an exemplary structure of the developer housing 100. As depicted therein, the developer housing 100 may include a developer roller 150, a transport roller 152, and a paddle wheel conveyor 154. The developer roller 150, transport roller 152, and the paddle wheel conveyor 154 may be disposed in a chamber 156 of the developer housing 100. As the toner and developer are dispensed from the toner container 110 and paddle wheel conveyor 154 so as to be intermixed with the carrier granules contained therein, forming a fresh supply of developer material. the developer container 111, the mixture of the toner and developer may be dispensed over the The developer roller 150 includes a non-magnetic tubular member over a magnetic rotor and is rotated in the direction of arrow 162. Similarly, the transport roller 152 may be made from a non-magnetic tubular member over a magnetic rotor and is rotated in the direction of arrow 164. The exterior circumferential surface of the tubular member of the transport roller 152 may be roughened to facilitate developer material movement.

The paddle wheel conveyor 154 may intermingle the fresh supply of toner particles with the carrier granules so as to form a new supply of developer material. The paddle wheel conveyor 154 may be made from a hub having a plurality of substantially equally spaced vanes extending radially outwardly therefrom and may be rotated in the direction of arrow 166. In this way, the toner particles may be advanced to the transport roller 152. With the rotation of the paddle wheel 154, the transport roller 152 rotates and the developer roller 150 may move the developer material into a development zone 168. In the development zone 168, the toner particles may be attracted from the carrier granules to the electrostatic latent image recorded on a photoconductive surface 170 of a drum 117.

Referring again to FIG. 1, the developer housing 100 may include a toner concentration sensor (TC sensor) 121 to monitor the concentration of the mixed toner and developer by detecting the tribo charge of the toner. If the TC sensor 121 determines that the concentration of the toner in the developer, a signal may be sent to a controller 122, which may be used to increase the supply of the toner so as to adjust the concentration of the mixture to a predetermined amount. The concentration may be predetermined and color or system dependent.

The photoreceptor belt 10 may then advance the developed latent image to transfer station D. At the transfer station D, a medium 24, such as, for example, paper, is advanced into contact with the developed latent images on the belt 10. A corona generating device 22 may charge the medium 24 to the proper potential so that it becomes tacked to the photoreceptor belt 10 and the toner powder image is attracted from the photoreceptor belt 10 to the medium 24. After transfer, a corona generator 23 charges the medium to an opposite polarity to detach the medium from the photoreceptor belt 10, whereupon the medium is stripped from the photoreceptor belt 10.

Sheets of the medium 24 may be advanced to a transfer station D from a supply tray 25. The medium 24 is fed from tray 25, with sheet feeder 26, and advanced to the transfer station D along a conveyor 27. After transfer, the medium 24 continues to move in the direction of an arrow 28 to a fusing station E. The fusing station E may include a fuser assembly 29, which permanently affixes the transfer toner powder images to the medium. Then the medium 24 is ejected to a tray 30 through a path 31.

Residual particles remaining on the photoreceptor belt 10 after each copy is made are removed at a cleaning station F for the next round of use. Accordingly, the image on the original is transferred to the medium 24 at a proper level of darkness.

Next, how the tribo charge of toner is adjusted is discussed.

Figure 3:
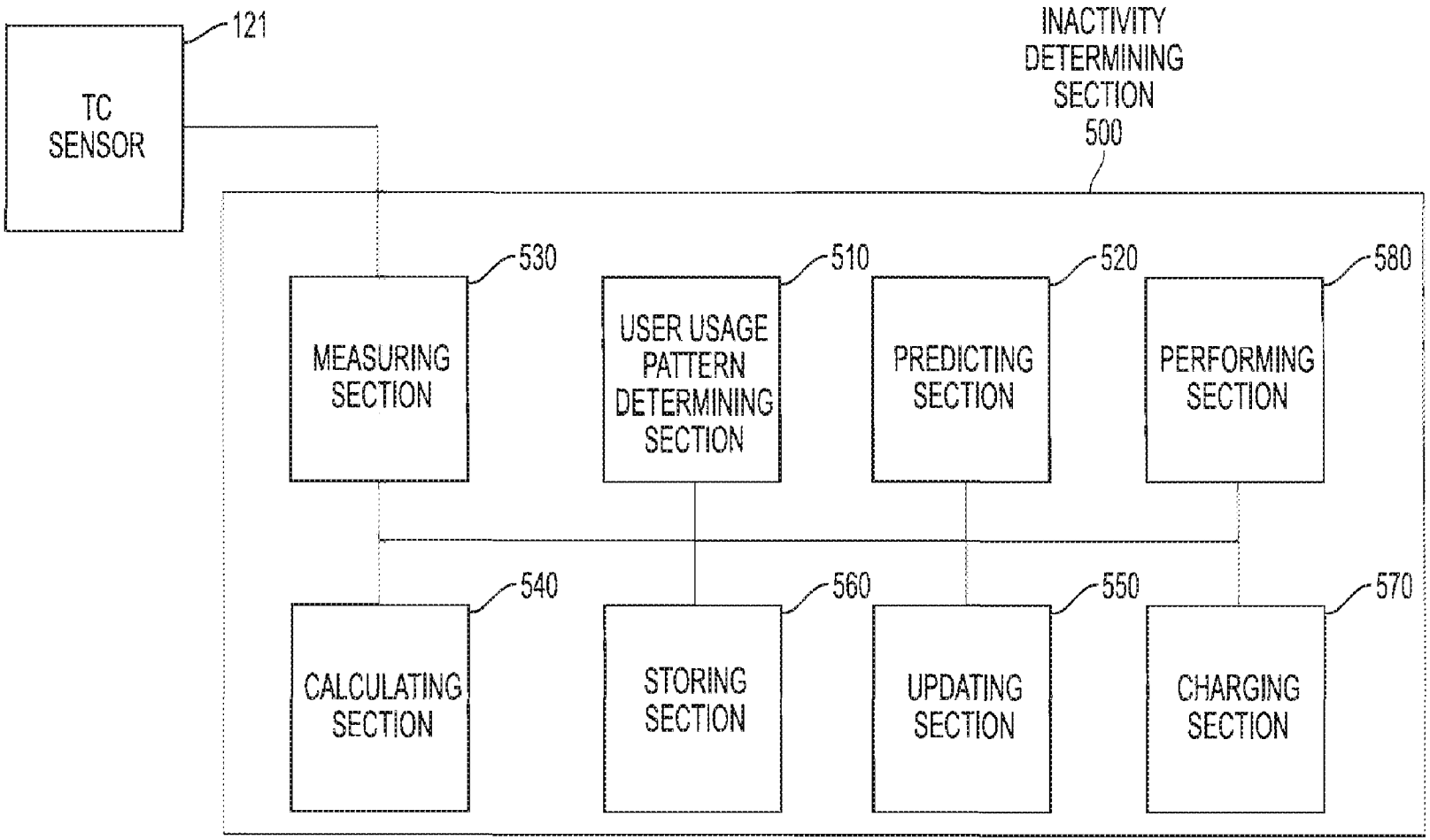
FIG. 3 illustrates a block diagram showing a toner charging system that charges the toner according to an exemplary embodiment.

FIG. 3 illustrates an exemplary embodiment of an intelligent toner charging system. The controller 122 may include inactivity determining section 500 which may determine an activity of the machine 1. The inactivity may be an idle period of the machine 1 in which the machine 1 is not used by a user and may be determined by the status of a printing operation. That is, if the user does not activate the machine 1 and if the machine 1 falls into an idle state, then the inactivity determining section 500 may determine that the machine is inactive.

The activity and inactivity of the machine 1 may be monitored by the inactivity determining section 500 periodically or continuously at any time. Such activity and inactivity of the machine 1 may also be monitored at a predetermined time of the day as may be configured by the user.

The relationship between the inactivity time and the tribo charge of the toner may be approximated by the following power law:

$$\text{Tribo charge}=\text{Steady state of tribo charge}\times\text{idle time}^{C}$$

where C is a constant dependent on age of the toner and relative humidity (RH). An exemplary value of C is −0.02.

The inactivity determining section 500 may include a user usage pattern determining section 510 that determines a usage pattern of the user. For example, the user usage pattern determining section 510 may monitor the usage of the user during the day and determine the usage pattern, such as the time for the first and last usages of the day and any inactivity pattern during the day that exceeds a predetermined length of time. The user usage pattern determining section 510 may be "self learning" and may determine the user pattern using an adaptive algorithm. Such an adaptive algorithm may detect long periods of inactivity, record the time and day of the week associated with these, and group/weight similar times to predict user behaviour. For example, the adaptive algorithm may record times of cycle-in (wake-up) after inactivity of more than 1 hour as follows: 8:10, 12:59, 8:06, 12:49, 8:09, 11:04, 12:55, 8:00, 13:05, 16:05, etc on weekdays. The adaptive algorithm may find two groups of highly weighed times and average them: 8:06 and 12:54. Two other time records (11:04, 16:05) may not be sufficiently associated with other time records to be considered a predictor of future behavior.

The user pattern may be determined from a collection of information of such usage by the user for a predetermined length of time, such as one or two weeks. The collected information may be recorded in a later-discussed storing section 560. The learning period may be continuous, a fixed initial time, or a moving window examining recent usage and may be pre-configured based on typical office hours followed by learning based on a moving window covering the past 4-8 weeks. The user may also configure the predetermined length of time in advance. Additionally, an initial usage pattern may be configured in advance.

The inactivity determining section 500 may also include a predicting section 520 that predicts the next user usage from the determination made by the inactivity determining section 500. In other words, the predicting section 520 predicts when the user is expected to next use the machine 1, based on a user usage pattern. For example, the predicting section 520 may predict the time for the first usage of the day by the user, by taking an average of recorded times of daily first usage.

Details of such calculations are described in, for example, U.S. patent application Ser. No. 11/776,743, which is incorporated herein by reference in its entirety.

The inactivity determining section 500 may also include a measuring section 530 that measures the TC sensor 121. The measuring system 530 may measure the sensor level at various times during the usage of the machine, including during the cycle-in and cycle-out of the machine.

The calculating section 540 calculates a decay of the tribo charge of the toner based on the difference between any two sensor levels of the TC sensor 121. For instance, the calculating section 540 may calculate the decay using the sensor level at the beginning of the inactivity period and the sensor level at the end of the inactivity level, that is, when the machine 1 "wakes up" from a sleep mode. The calculating section 540 may also calculate a decay of tribo charge based on an equation to predict the tribo when "waking" from sleep mode.

The inactivity determining section 500 may further include an updating section 550 and a storing section 560. The updating section 550 updates information on the user usage pattern, the predicated next user usage, sensor levels measured by the measuring section 530 and the decay calculated by the calculating section 540. The storing section 560 may store such information for future usage.

Upon determination of the inactivity, a charging section 570 may instruct the machine 1 to charge the toner to a predetermined level that is suitable for performing a printing operation. The charging section 570 may instruct the machine 1 to charge the developer based on the decay calculated by the calculating section 540.

A performing section 580 may perform a printing operation after the developer is changed by the charging section 570. In particular, the performing section 580 pre-runs the machine 10 to perform the printing operation to ensure that the developer is at an adequate charge level for normal printing.

Figure 4:
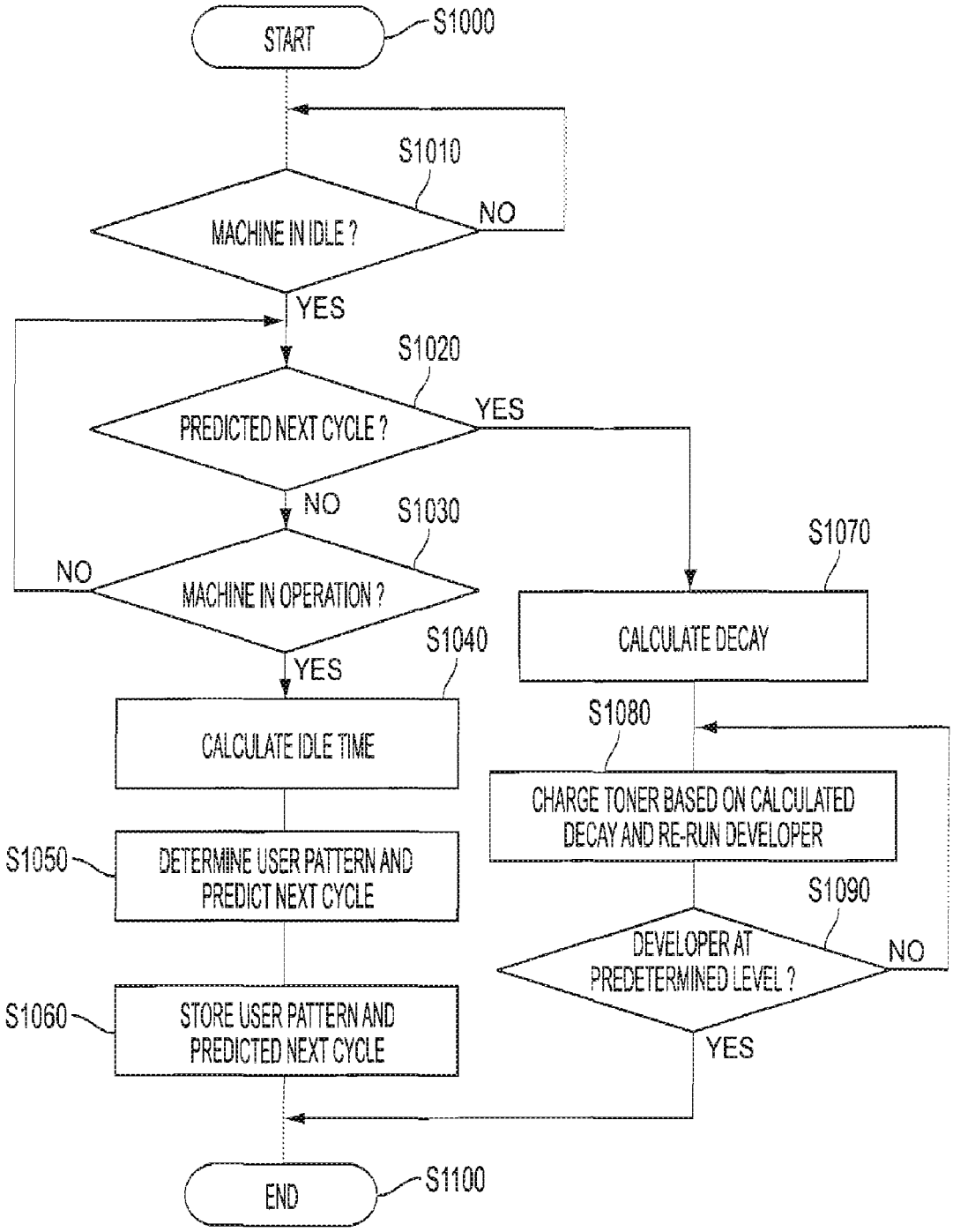
FIG. 4 illustrates a flowchart showing a flow of charging the toner according to an exemplary embodiment.

FIG. 4 illustrates a flow chart of a method for charging the developer. The process starts at S1000 and continues to S1010. As shown at S1010, a determination may be made as to whether the machine 1 is inactive. The inactivity may be, for example, an idle period of the machine 1 in which the machine 1 is not used by a user and may be determined by the status of printing operation.

If the machine 1 is not inactive, then the process repeats at S1010. Otherwise, the process makes a prediction of the next cycle as shown at S1020. For example, at step S1020, a determination may be made as to whether the user's predicted next usage has been reached. If the predicted user's next usage has not been reached, the process continues as shown at S1030. If the predicted user's next usage has been reached, the process continues as shown at S1070.

More specifically, a determination may be made as to whether the machine 1 has awaken from a sleep mode, that is, whether the machine 1 is in operation, as shown at S1030. If so, the process continues as shown at S1040. If not, the process returns to the prediction cycle as shown at S1020.

Furthermore, as shown at S1040, the idle time may be calculated, and then the user pattern may be determined from the idle time, as shown at S1050. That is, when the machine 1 became inactive and when the machine 1 was operated next, may be determined. The next user usage may be determined based on this user pattern and the previous user patterns. The user pattern may be determined using an adaptive algorithm.

Then the user pattern and predicted next cycle may be stored in a storing section for future use, as shown at S1060. Then the process ends as shown at S1100.

If the determination of the predicted next cycle, as shown at S1020 is positive, that is, if the predicted next user's usage has been reached, then decay may be calculated from the inactivity period, as shown at S1070. For example, the tribo charge=steady state of tribo charge×idle time$^{C}$, where C may be a constant dependent on age of the toner and RH.

Then, the toner may be charged based on the calculated decay, and the machine 1 may pre-run the developer, as shown at S1080. The tribo charge of the toner may be measured, and a determination may be made as to whether the toner is charged to a predetermined level, as shown at S1090. If so, the process ends at S1100. If not, the process may return and repeat to charge the toner, as shown at S1080.

Figure 5:
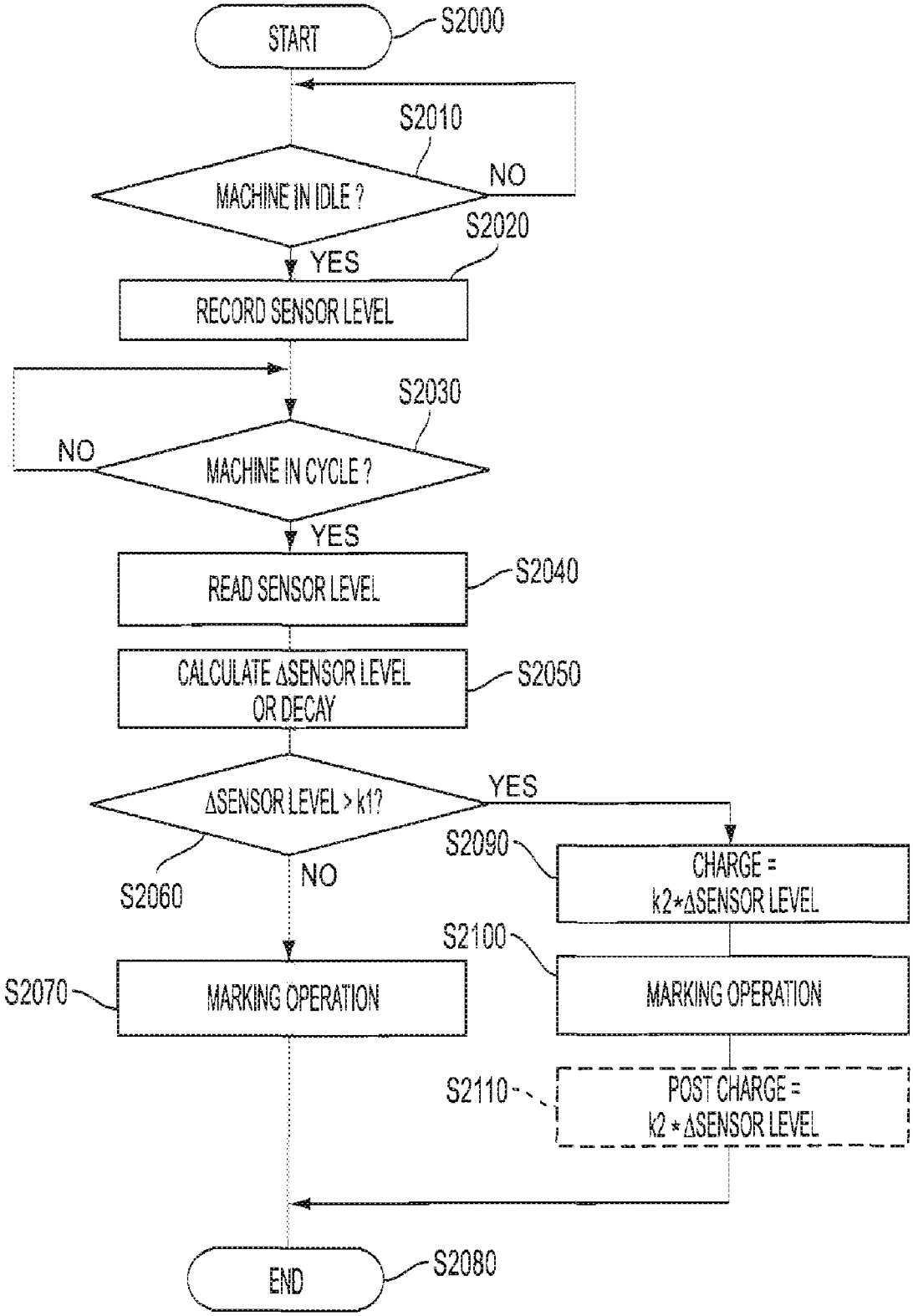
FIG. 5 illustrates a flowchart showing another flow of charging the toner according to an exemplary embodiment.

FIG. 5 illustrates a flowchart of a second method for charging the developer. The process starts at S2000 and continues to S2010. More specifically, the process begins when a determination is made as to whether the machine is inactive, as shown at S2010. The inactivity may be an idle period of the machine 1 in which the machine 1 is not used by a user and may be determined by the status of printing operation. If the machine 1 is not inactive, then the process as shown at S2010 may repeat.

If the machine 1 is inactive, then a sensor level of the TC sensor 121 may be measured and recorded, as shown at S2020. Then, a determination may be made as to whether the machine 1 has become active, as shown at S2030. If the machine 1 has not become active, then the process repeats, as shown at S2030. If the machine 1 has become active, then the sensor level of the TC sensor 121 may again measure and record, as shown at S2040.

Next, a difference between the two sensor levels may be calculated to determine decay of the toner, as shown at S2050. That is, the change in the tribo charge levels may be determined. A determination may be made as to whether the difference between the two sensor levels is greater than a first value k1, as shown at S2060. The first value k1 may be a threshold value to determine that the tribo charge of the toner is low enough to cause deficiency in the printed image.

If the difference between the two sensor levels is not greater than the first value k1, the process may continue and perform normal marking operations, as shown at S2070. Then, the process may end as shown at S2080.

If the difference is greater than the constant k1 at S2060, the process may move to S2090. That is, the toner may be charged by a multiplication of a second value k2 and the difference between the sensor levels, as shown at S2090. The value k2 may be a constant to adjust the tribo charge of the toner to the predetermined charge level. Then, the process may continue to step S2100 and may perform a marking operation.

The toner optionally may again be charged by a multiplication of a third value k3 and the difference between the sensor levels, as shown at S2110. This ensures that the toner has a tribo charge for the normal operation. Then, the process may end as shown at S2080.

Either one of the above-described exemplary methods may be sufficient to adjust the tribo charge of the toner. However, it will be appreciated that both methods may be used as a combination to even more accurately adjust the tribo charge of the toner.

The disclosed methods may be readily implemented in software, such as by using object or object-oriented software development environments that provide portable source code that can be used on a variety of computer or workstation hardware platforms. Alternatively, appropriate portions of the disclosed intelligent toner charging system may be implemented partially or fully in hardware using standard logic circuits or a VLSI design. Whether software or hardware is used is dependent on the speed and/or efficiency requirements of the system, the particular function, and the particular software or hardware systems or microprocessor or microcomputer systems being utilized. The processing systems and methods described above, however, can be readily implemented in hardware or software using any known or later developed systems or structures, devices and/or software by those skilled in the applicable art without undue experimentation from the functional description provided herein together with a general knowledge of the computer arts.

It will be appreciated that variations of the above-disclosed and other features and functions, or alternatives thereof may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method for tribo charging toner used in an imaging device, comprising:

determining one or more periods of inactivity of the imaging device;

calculating a current tribo charge due to decay from the determined one or more periods of inactivity, the calculation being determined by $$\text{Tribo}=S\times T^{C}$$

where Tribo is the calculated current tribo charge, S is a steady state of tribo charge of the toner prior to the inactivity, T is idle time of the imaging device, and C is a constant depending on age of the toner and relative humidity; and tribo charging the toner from the calculated current tribo charge due to decay to a predetermined level based on the determined one or more periods of activity.

2. The method according to claim 1, further comprising:

determining a usage pattern based on the determined one or more periods of inactivity of the imaging device; and predicting a next usage based on the usage pattern, wherein the toner is charged at a time of the predicted next usage.

3. The method according to claim 2, wherein the usage pattern is determined using an adaptive algorithm based on a calculation of the one or more periods of inactivity.

4. The method according to claim 2, further comprising:

storing the usage pattern upon recovery from the one or more periods of inactivity, wherein the imaging device recovers from the inactivity; and updating the stored usage pattern when recovering from the inactivity.

5. The method according to claim 1, further comprising:

performing a printing operation using the charged toner; and if after imaging the toner is still not charged at the predetermined level, charging the toner after the imaging operation to the predetermined level.

6. An apparatus for tribo charging a toner for an imaging device, comprising:

an inactivity determining section that determines one or more periods of inactivity of the imaging device;

a measuring section that measures a steady state of tribo charge of the toner;

a calculating section that calculates a current tribo charge due to decay from the determined one or more periods of inactivity, the calculation being determined by $$\text{Tribo}=S\times T^{C}$$

where Tribo is the calculated current tribo charge, S is a steady state of tribo charge of the toner prior to the inactivity, T is idle time of the imaging device, and C is a constant depending on age of the toner and relative humidity; and a tribo charging section that tribo charges the toner from the calculated current tribo charge due to decay to a predetermined level based on at least one of the determined one or more periods of inactivity and the measured tribo charge of the toner.

7. The apparatus according to claim 6, wherein the inactivity determining section includes:

a usage pattern determining section that determines a usage pattern based on the determined one or more periods of inactivity of the imaging device; and a predicting section that predicts a next usage based on the usage pattern, wherein the charging section charges the toner at the predicted next usage.

8. The apparatus according to claim 7, wherein the usage pattern determining section determines the usage pattern using an adaptive algorithm based on a calculation of the one or more periods of inactivity.

9. The apparatus according to claim 8, wherein the inactivity determining section includes:

a storing section that stores the usage pattern upon recovery from the one or more periods of inactivity, wherein the imaging device recovers from the inactivity;

an updating section that updates the stored usage pattern when recovering from the inactivity.

10. The apparatus according to claim 6, wherein the charging section charges the toner based on a difference between the measured charge of toner and the predetermined level.

11. The apparatus according to claim 6, wherein the inactivity determining section includes:

a calculating section that calculates a decay of the toner, wherein the charging section charges the toner based on the calculated decay of the toner.

12. The apparatus according to claim 6, wherein the charge of toner is measured by a toner concentration sensor that determines concentration of the toner in a developer.

13. The apparatus according to claim 6, wherein the charging section performs a print operation using the charged toner, and the charging section repeats the charge to the toner when the charged toner is not at the predetermined level.

14. A xerographic machine including the apparatus according to claim 6.

* * * * *